United States Patent [19]

Clark

[11] Patent Number: 4,807,580

[45] Date of Patent: Feb. 28, 1989

[54] TRIGGER MECHANISM FOR ENGINES

[75] Inventor: Leonard R. Clark, Rock Hill, S.C.

[73] Assignee: Textron Inc., Providence, R.I.

[21] Appl. No.: 77,111

[22] Filed: Jul. 23, 1987

[51] Int. Cl.[4] ..... F02D 11/04

[52] U.S. Cl. ..... 123/398; 123/396

[58] Field of Search ..... 123/396, 398, 400

[56] References Cited

U.S. PATENT DOCUMENTS

| | | | |
|---|---|---|---|
| 1,583,959 | 5/1926 | Church | 123/398 |
| 1,660,731 | 2/1928 | Taylor | 123/396 |
| 2,866,446 | 12/1958 | Feverstein et al. | 123/400 X |
| 2,891,417 | 6/1959 | Beegle | 123/398 X |
| 3,330,528 | 7/1967 | Stratton | 123/398 X |

*Primary Examiner*—Tony M. Argenbright

*Attorney, Agent, or Firm*—Abraham Ogman

[57] ABSTRACT

The invention is directed to a trigger mechanism for gasoline operated equipment where a trigger is operatively connected to a throttle by a lever. The mechanism includes latch means which regulates the speed of the engine, and an idle setting means. The latch means also stops or shuts the engine down when it is depressed.

6 Claims, 1 Drawing Sheet

TRIGGER MECHANISM FOR ENGINES

BACKGROUND OF THE INVENTION

The invention is directed to a fully integrated trigger mechanism which provides the functions of latching the speed of the engine at a predetermined speed, returning the engine to its idle speed when the trigger is depressed, and stopping the engine when the latch means is depressed. The forgoing integrated functions are performed using a cam equipped latch mechanism.

The number of trigger mechanisms for engines are numerous and varied in their designs and operation. Most do not perform all of the functions specified above. Where the speed can be varied by actuating a trigger an accompanying latch provides only a few, 1–3, discrete positions. Additionally, there is no known trigger mechanism which utilizes the latch to control the idle speed, maintain a desired speed and also shut down the engine.

It will become obvious that the trigger mechanism described in this application can be used in many applications. For this discussion however the trigger mechanism will be described in connection with a gasoline engine driven blower-vacuum unit.

OBJECTS

It is an object of the invention to provide a trigger mechanism which avoids the disadvantages and limitations of prior mechanisms.

It is another object of the invention to provide a trigger mechanism which includes a latch that maintains a speed setting, an idle speed adjustment and shuts down the engine.

It is yet another object of the invention to provide a trigger mechanism that contains means for maintaining a wide range of predetermined speeds.

It is yet another object of the invention to provide a trigger mechanism for use with a trigger situated within a handle and a remote throttle.

It is still another object of the invention to provide a trigger mechanism of relatively simple design and improved reliability.

It is still another object of the invention to provide a cam actuated speed control means which operates over a wide range of speeds.

SUMMARY OF THE INVENTION

A trigger mechanism for an engine having a throttle comprises a trigger connected to a a lever having idle, full throttle and stop positions interconnecting the trigger and the throttle, said lever has a first interlocking means.

Also included is a normally raised latch means adapted to be rotated or depressed. The latch has second interlocking means for engaging said first interlocking means when the latch is rotated for holding the level in a predetermined position between the idle and full throttle positions.

The latch means also includes means for separating the first and second interlocking means to permit the lever to return to the idle position when the trigger is depressed, or to permit the lever to go to the stop position when the latch is depressed.

THE DRAWINGS

The invention will be described in more detail below in conjunction with the following drawings.

DESCRIPTION OF THE INVENTION

Figures 1, 2, 3:
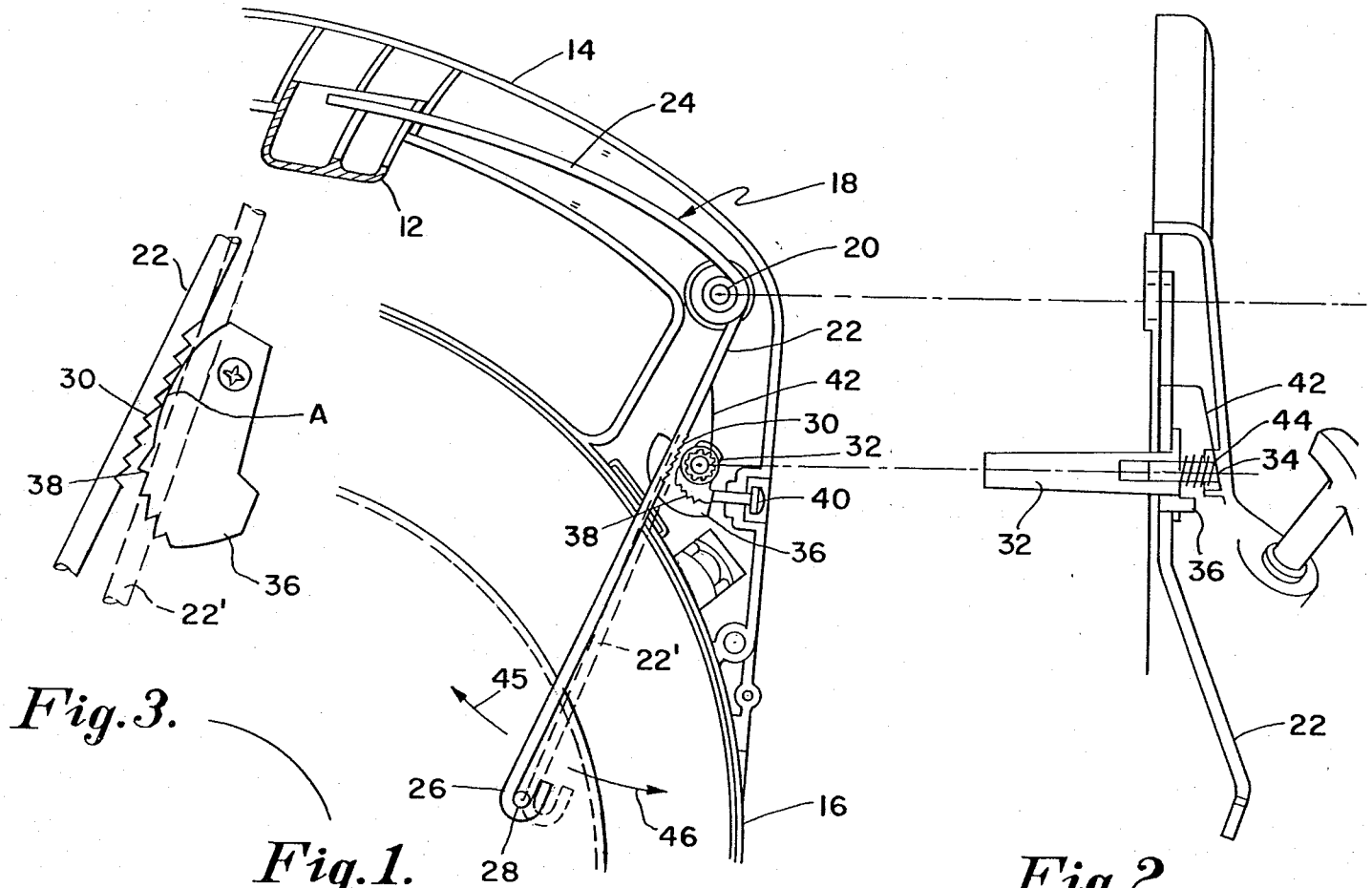
FIG. 1 is a partial view of a blower vacuum unit with one half of the housing removed to review the details of the trigger mechanism.
FIG. 2 is a side view of the latch means of the trigger mechanism.
FIG. 3 is an enlarged view of the interlocking teeth.

A trigger mechanism 10 is detailed in FIGS. 1 and 2. A trigger 12 is situated in a handle 14 of a blow-vacuum unit 16. The trigger is connected to a lever 18 mounted for rotation on a pivot 20 having legs 22 and 24. Leg 22 depends from the pivot 20 and terminates in a "J" hook 26 connected to a throttle 28 of an engine, not shown. Intermediate the pivot 20 and the "J" hook there are a plurality of teeth 30 forming a type of "rack" of a rack and pinion.

Also displayed in the figures is a latch means 32 which may be rotated clockwise in FIG. 1 on a pivot 34 or axially depressed on the pivot 34 from an elevated position shown in the FIG. 2.

The latch means 32 terminates in a cam 36 containing a plurality of teeth 38 which are designed to mesh and interlock with the teeth 30 on the leg 22 when the latch means 32 rotates the cam 36 clockwise. The teeth 38 act like a pinion of the rack and pinion.

A screw 40 bearing against the cam 36 acts as the idle speed adjustment screw. A spring 42 holds the assembly loosely together. The spring 42 also biases the leg 22 toward the right and against the cam 36.

A spring 44 biases the latch means 32 in the raised position shown in FIG. 2. It also biases the latch means 32 in its extreme counter clockwise position, as viewed in FIG. 1, of its travel.

OPERATION

In FIG. 2 the trigger mechanism is shown in its idle speed position. The cam 36 rests against the idle speed adjustment screw 40. There are no teeth on the cam 36 at point "A" to permit the idle speed adjustment screw 40 to adjust the idle speed without inteference from meshing teeth. This is the limit of the travel in the clockwise direction by the spring 44 bias on the latch means 32 and cam 36.

When the trigger 12 is depressed the leg 22 of the lever 18 moves clockwise in the direction of arrow 44 and the speed of the engine is increased. To set the speed to a predetermined value, the latch means 32 is rotated clockwise until the teeth 30 and the teeth 38 mesh or interlock. The trigger 12 then remains in this position when it is released.

To return to idle the trigger 12 is depressed moving the leg 22 to the left allowing the spring 44 to rotate the cam 36 until is is stopped by the idle speed adjustment screw 40. To shut down the engine the latch means 32 is axially depressed. The leg 22 slips of the cam and moves counter clockwise in the direction of arrow 46. See 22'. The throttle 28 acting on the carburetor closes the carburetor throttle plate, for example, thus stopping the engine.

The lever leg 22 holds the latch means 32 in the depressed position until the trigger is depressed moving the leg 22 in the direction of the arrow 44 allowing the latch means 32 to return to its elevated position and permitting the idle speed adjustment screw to once again control the speed of the engine at position "A".

The teeth 30 and 38 may be replaced by friction surfaces. This construction is generally limited to applications where the vibration of the apparatus can be sufficiently controlled to avoid separating the friction surfaces.

To construction and operation of the trigger mechanism 10 is both simple and reliable. It features means for setting the engine speed to many values. All of the functions of controlling the engine are integrated into two parts namely a trigger operated level and a latch means. All of the controls are handy and in the case illustrated situated in the handle.

It will of course be understood that various changes may be made in the form, details, arrangement and proportions of the various parts without departing from the scope of the invention.

What is claimed is:

1. A trigger mechanism for a blower-vacuum apparatus having a trigger mounted within a handle and a small engine comprising:

a throttle:

a "L" shaped lever having first and second legs mounted for rotation about an intermediate pivot within the handle when the trigger is depressed, interconnecting the trigger and the throttle, the second leg having first teeth defined therein, said lever further having idle, full throttle and stop positions;

a normally raised latch means adapted to be rotated and axially depressed, said latch means having second teeth situated on a cam to engage the first teeth for holding the lever in an intermediate position between the idle and full throttle positions when the latch means is rotated, said latch means further being spring biased for moving the cam teeth into potential engagement with the lever teeth when the trigger is depressed, said lever being spring biased to the stop position; and idle adjusting means means for intercepting the second leg for preventing the second leg from reaching the stop position when the latch means is raised.

2. A trigger mechanism for an engine having a throttle comprising:

a trigger;

a lever having idle, full throttle and stop positions interconnecting the trigger and the throttle, said lever having first interlocking means;

a normally raised latch means adapted to be rotated or depressed having second interlocking means for engaging said first interlocking means when the latch is rotated for holding the lever in a predetermined position between the idle and full throttle positions, said latch means also for separating the first and second interlocking means to permit the lever to return to the idle position when the trigger is depressed, or to permit the lever to go to the stop position when the latch is depressed.

3. A trigger mechanism as defined in claim 2 wherein the trigger mechanism includes idle means for intercepting the movement of the lever when the trigger is depressed to prevent the lever from going to the stop position.

4. A trigger mechanism as defined in claim 2 wherein:

the lever is a "L" shaped lever rotatable about an intermediate pivot and having a depending leg containing the the first interlocking means; and the latch means contains a cam rotatable with the latch means containing the second interlocking means.

5. A trigger mechanism as defined in claim 2 wherein:

the latch means is axially biased to its raised position; the latch means is rotationally biased to normally separate the interlocking means;

the lever is normally biased to the stop position; and said trigger mechanism further contains idle means for spacing the lever from the stop position when the latch means is in its raised position for idling the engine.

6. A trigger mechanism as defined in claim 4 wherein the trigger and the lever and the intermediate pivot are all mounted in a handle of gasoline operated apparatus and the depending leg is connected to the throttle.

* * * * *